US009617068B2

(12) United States Patent
Rauser

(10) Patent No.: US 9,617,068 B2
(45) **Date of Patent: *Apr. 11, 2017**

(54) OFFSET LAMINATE SEAM SYSTEM FOR STORAGE BINS

(71) Applicant: Claire M. Rauser, Kindred, ND (US)

(72) Inventor: Claire M. Rauser, Kindred, ND (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/186,654

(22) Filed: Jun. 20, 2016

(65) Prior Publication Data

US 2016/0297608 A1 Oct. 13, 2016

Related U.S. Application Data

(63) Continuation of application No. 14/070,129, filed on Nov. 1, 2013, now Pat. No. 9,371,660.

(51) Int. Cl.

| | |
|---|---|
| ***E04H 7/30*** | (2006.01) |
| ***B65D 90/02*** | (2006.01) |
| ***B65D 88/08*** | (2006.01) |

(52) U.S. Cl.

CPC ..... *B65D 90/028* (2013.01); *B65D 88/08* (2013.01); *B65D 90/027* (2013.01); *E04H 7/30* (2013.01); *B65D 2588/02* (2013.01); *B65D 2590/02* (2013.01)

(58) Field of Classification Search

CPC .... B65D 90/023; B65D 90/024; B65D 9/043; B65D 90/045; B65D 90/08; B65D 90/028; B65D 88/08; B65D 90/027; B65D 2588/02; B65D 2590/02; E04H 7/22; E04H 7/24; E04H 7/30; E04H 12/08; E04H 12/34; E04H 12/085; E04H 2007/225

USPC ... 52/40, 245, 246, 249, 834, 578, 462, 464, 52/584.1; 403/300, 312

See application file for complete search history.

(56) References Cited

U.S. PATENT DOCUMENTS

| | | | | |
|---|---|---|---|---|
| 547,155 | A | 10/1895 | Ogden | |
| 737,078 | A | 8/1903 | Chapman | |
| 1,427,166 | A | 8/1922 | Parton | |
| 2,955,686 | A | 10/1960 | Blomeley | |
| 3,340,658 | A | 9/1967 | Dueringer | |
| 4,188,759 | A | 2/1980 | Liet | |
| 4,603,525 | A | 8/1986 | Byers | |
| 5,829,209 | A | 11/1998 | Keyl | |
| 8,291,664 | B2 | 10/2012 | Hanig | |
| 9,371,660 | B2 * | 6/2016 | Rauser | E04H 7/30 |
| 2008/0041009 | A1 | 2/2008 | Cairo | |
| 2009/0242577 | A1 | 10/2009 | Dingeldein | |

* cited by examiner

*Primary Examiner* — Theodore Adamos

(74) *Attorney, Agent, or Firm* — Neustel Law Offices; Michael S. Neustel

(57) ABSTRACT

An offset laminate seam system for storage bins for increasing the capacity of bolts in a seam of a storage bin. The offset laminate seam system for storage bins generally includes three or more panels connected together with two or more vertical rows of end fasteners to form a vertical seam. The interconnection of three or more panels continues to form a ring structure. A plurality of the ring structures are stacked upon one another and attached together with fasteners to form the wall of the storage bin and a roof is attached to the uppermost ring structure.

20 Claims, 14 Drawing Sheets

OFFSET LAMINATE SEAM SYSTEM FOR STORAGE BINS

CROSS REFERENCE TO RELATED APPLICATIONS

I hereby claim benefit under Title 35, United States Code, Section 120 of U.S. patent application Ser. No. 14/070,129 filed Nov. 1, 2013. This application is a continuation of the Ser. No. 14/070,129 application. The Ser. No. 14/070,129 application is currently pending. The Ser. No. 14/070,129 application is hereby incorporated by reference into this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to particulate material storage bins and more specifically it relates to an offset laminate seam system for storage bins for increasing the capacity of bolts and metal panels in a connection seam of a storage bin.

Description of the Related Art

Any discussion of the related art throughout the specification should in no way be considered as an admission that such related art is widely known or forms part of common general knowledge in the field.

Conventional particulate storage bins such as grain bins are often times constructed of a hollow cylindrical structure having a single circular sidewall and a roof attached to the upper end of the sidewall. Conventional storage bins are comprised of a plurality of panels that are bolted together in series with one another to form a plurality of rows, wherein each of the rows of panels are attached to one another to form the sidewall. Conventional storage bins range from 30 feet to over 105 feet in diameter with capacities up to 710,624 bushels or more.

As storage bins become larger in diameter and/or height, the forces applied to the sidewall and particularly the intersections for each panel increase because of the increase of particulate material (e.g. grain) stored within that applies an outward force to the sidewall. Furthermore, changes in temperature of the particulate material stored can cause expansion and thermal ratcheting thereby increasing the outward forces applied to the wall of the storage bin.

One of the main problems is that only two panels of the sidewall are connected together creating a single shear point for the bolts requiring stronger bolts to be used to avoid grain bin failure. However, when stronger bolts are used, conventional storage bins still are prone to failure by the tearing of the sheet metal used for the sidewalls because of the significant forces being applied to the distal ends of the sheet metal panels.

Because of the inherent problems with the related art, there is a need for a new and improved offset laminate seam system for storage bins for increasing the capacity of bolts in a seam of a storage bin.

BRIEF SUMMARY OF THE INVENTION

The invention generally relates to a particulate material storage bins which includes three or more panels connected together with two or more vertical rows of end fasteners to form a vertical seam. The interconnection of three or more panels continues to form a ring structure. A plurality of the ring structures are stacked upon one another and attached together with fasteners to form the wall of the storage bin and a roof is attached to the uppermost ring structure.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
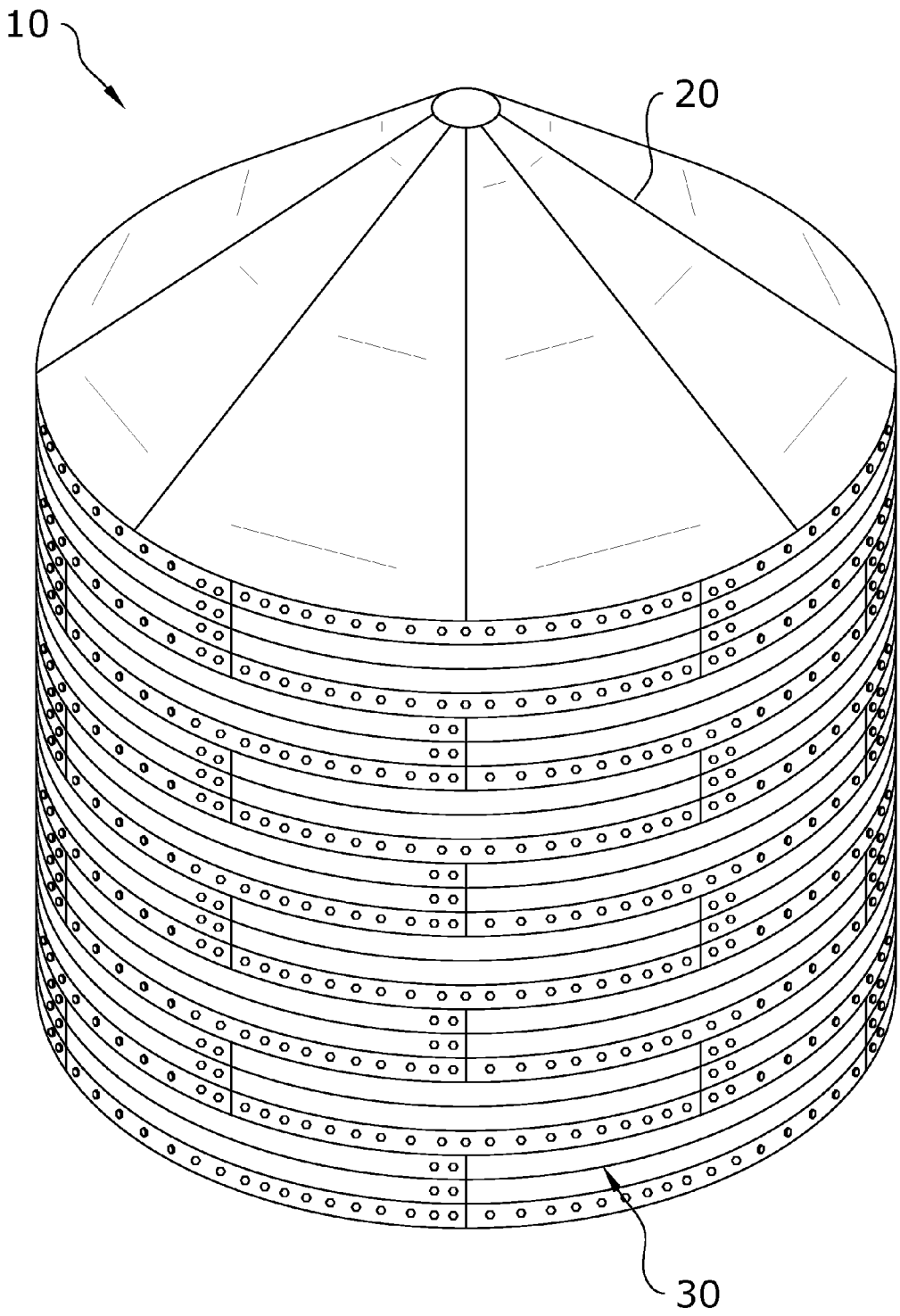
FIG. 1 is an upper perspective view of the present invention fully assembled into a storage grain bin.

Turning now descriptively to the drawings, in which similar reference characters denote similar elements throughout the several views, FIGS. 1 through 5 illustrate an offset laminate seam system for storage bins 10, which comprises three or more panels connected together with two or more vertical rows of end fasteners 80 to form a vertical seam 32. The interconnection of three or more panels continues to form a ring structure. A plurality of the ring structures are stacked upon one another and attached together with fasteners to form the wall 30 of the storage bin and a roof 20 is attached to the uppermost ring structure. The panels are comprised of sheet metal such as corrugated sheet metal. The panels may be comprised of any material or structure commonly utilized for the construction of grain bins.

Figure 2A:
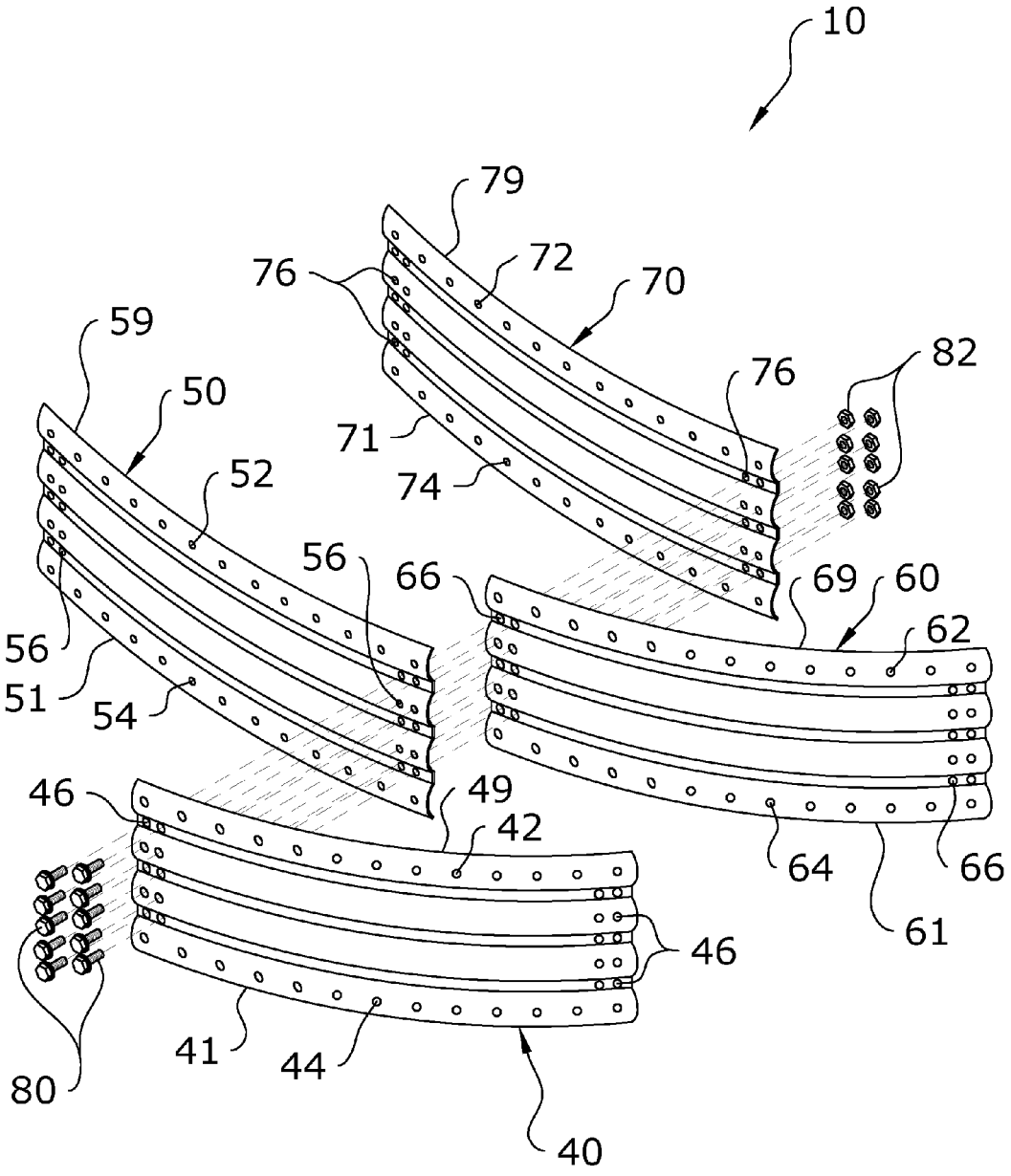
FIG. 2*a* is an exploded upper perspective view of four panels that are to be attached together.
Figure 2B:
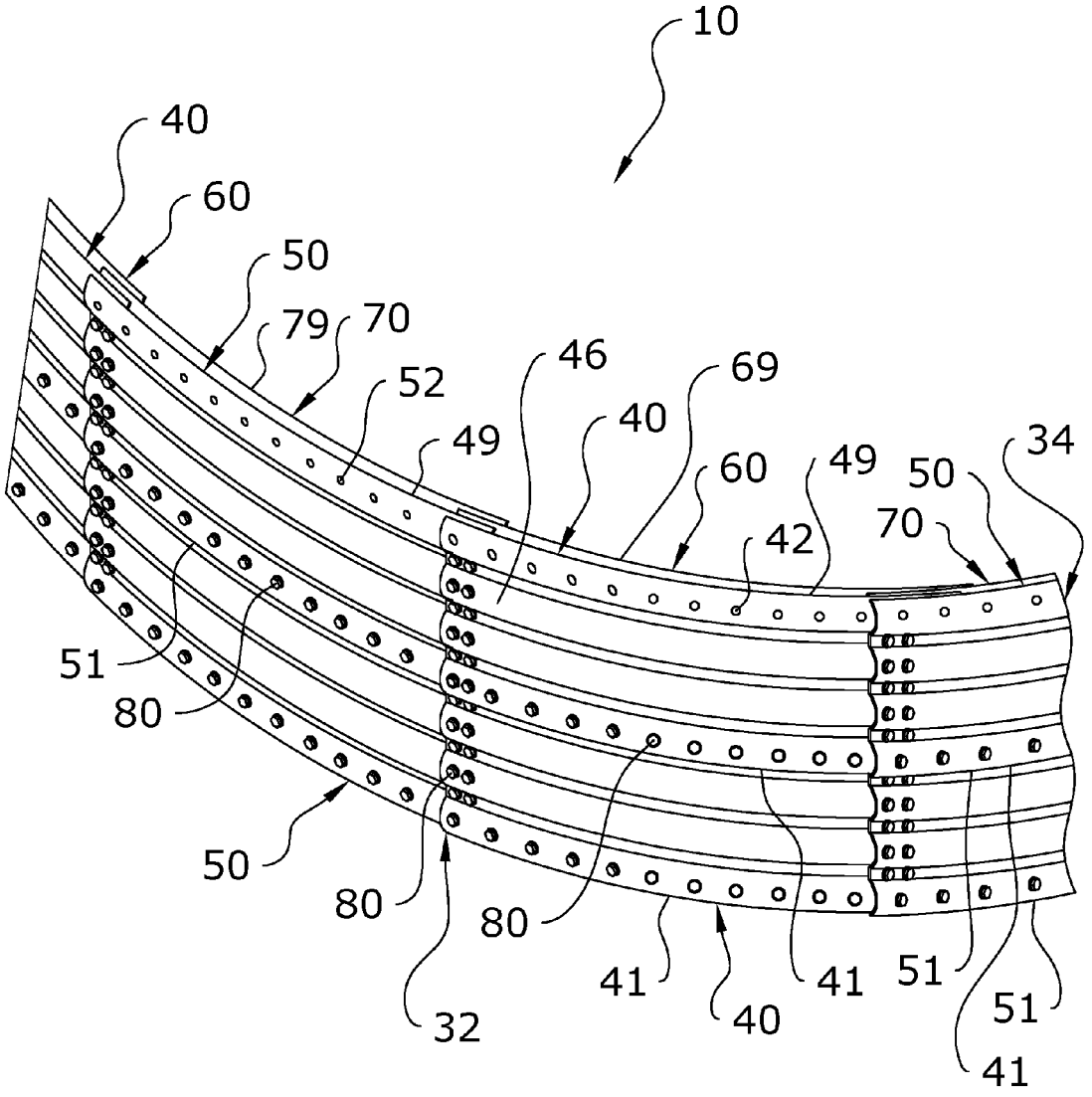
FIG. 2*b* is an upper perspective view of the four panels connected together in an overlapped manner creating three shear points on the bolts in the vertical seam.
Figure 4A:
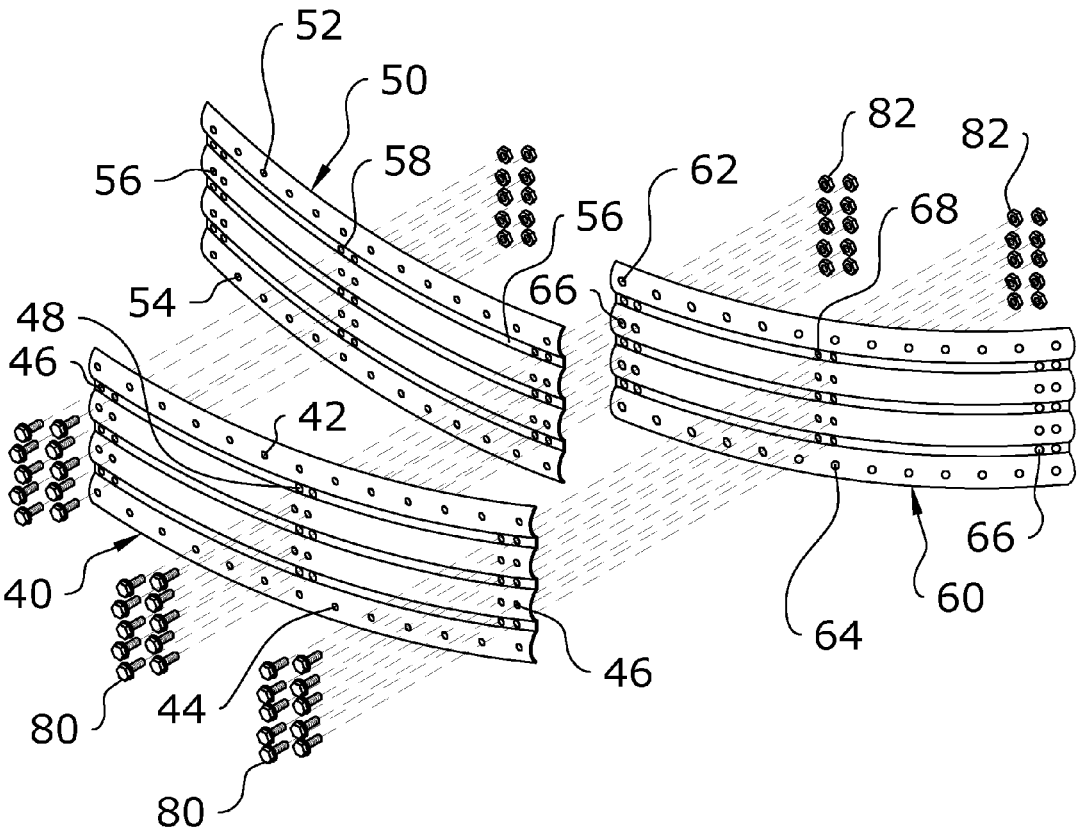
FIG. 4*a* is an exploded upper perspective view of an alternative embodiment comprised of three panels that are to be attached together.
Figure 4B:
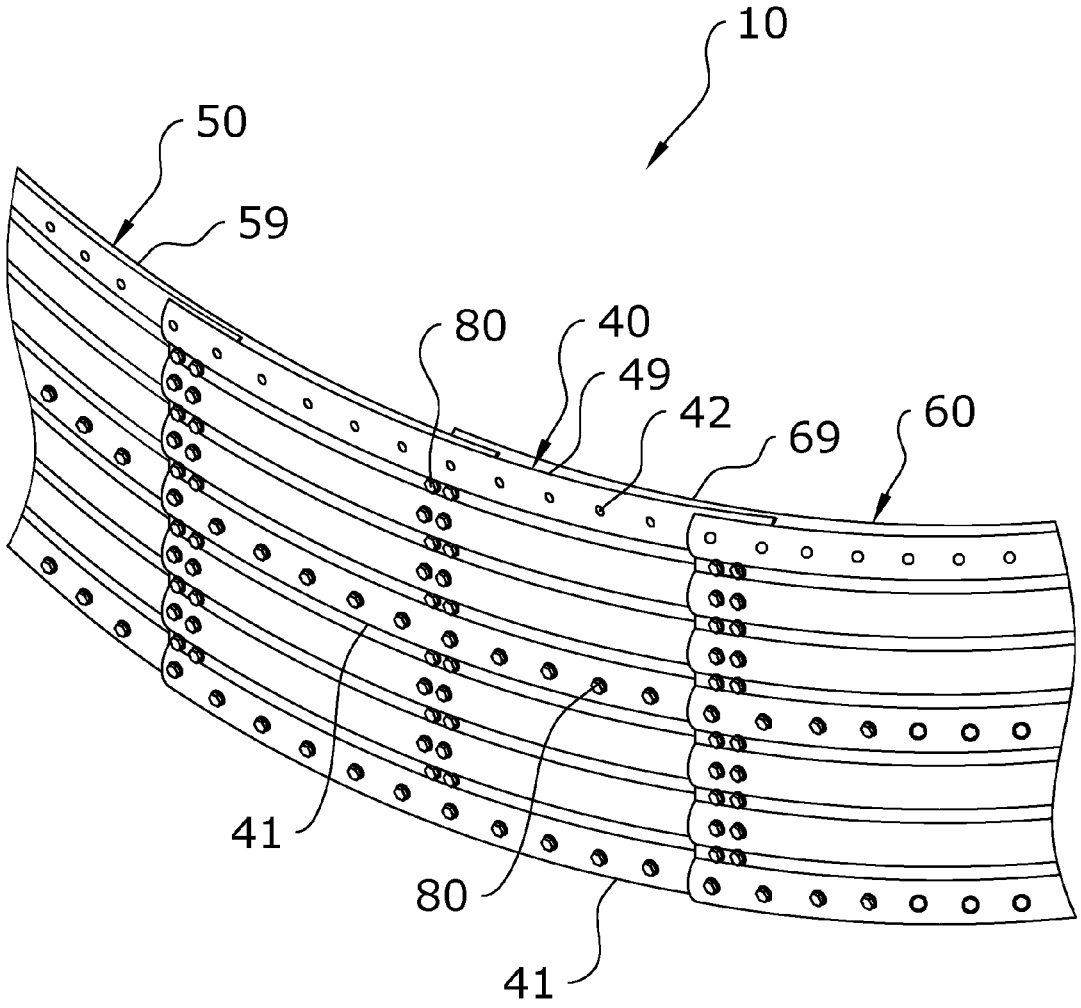
FIG. 4*b* is an upper perspective view of the alternative embodiment fully assembled into a ring structure.

The present invention is comprised of a wall 30 for a particulate material storage bin having a plurality of sections connected together forming a ring structure (e.g. FIGS. 2*a* and 4*a* each illustrate one section of the wall 30). FIGS. 2*d* and 4*d* illustrate a completed ring structure for both embodiments of the invention wherein a plurality of sections are interconnected as illustrated. A plurality of rows of the ring structure are vertically stacked to form a cylindrical structure for the wall 30 that is capped with a roof 20 at the top as shown in FIG. 1 of the drawings. At least one of the plurality of sections comprises at least three panels comprised of a metal panel structure, wherein the at least three panels are connected together via a vertical seam 32 with a plurality of fasteners (e.g. bolts). At least two of the at least three panels have their respective end portions connected to the vertical seam 32.

B. First Embodiment

Figure 2C:
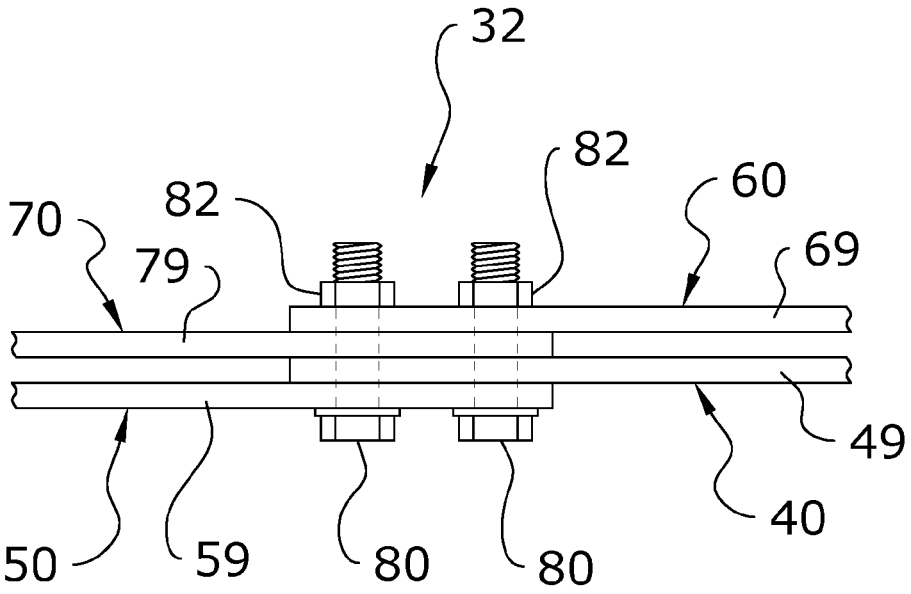
FIG. 2*c* is a top magnified view of the vertical seam for the present invention.
Figure 2D:
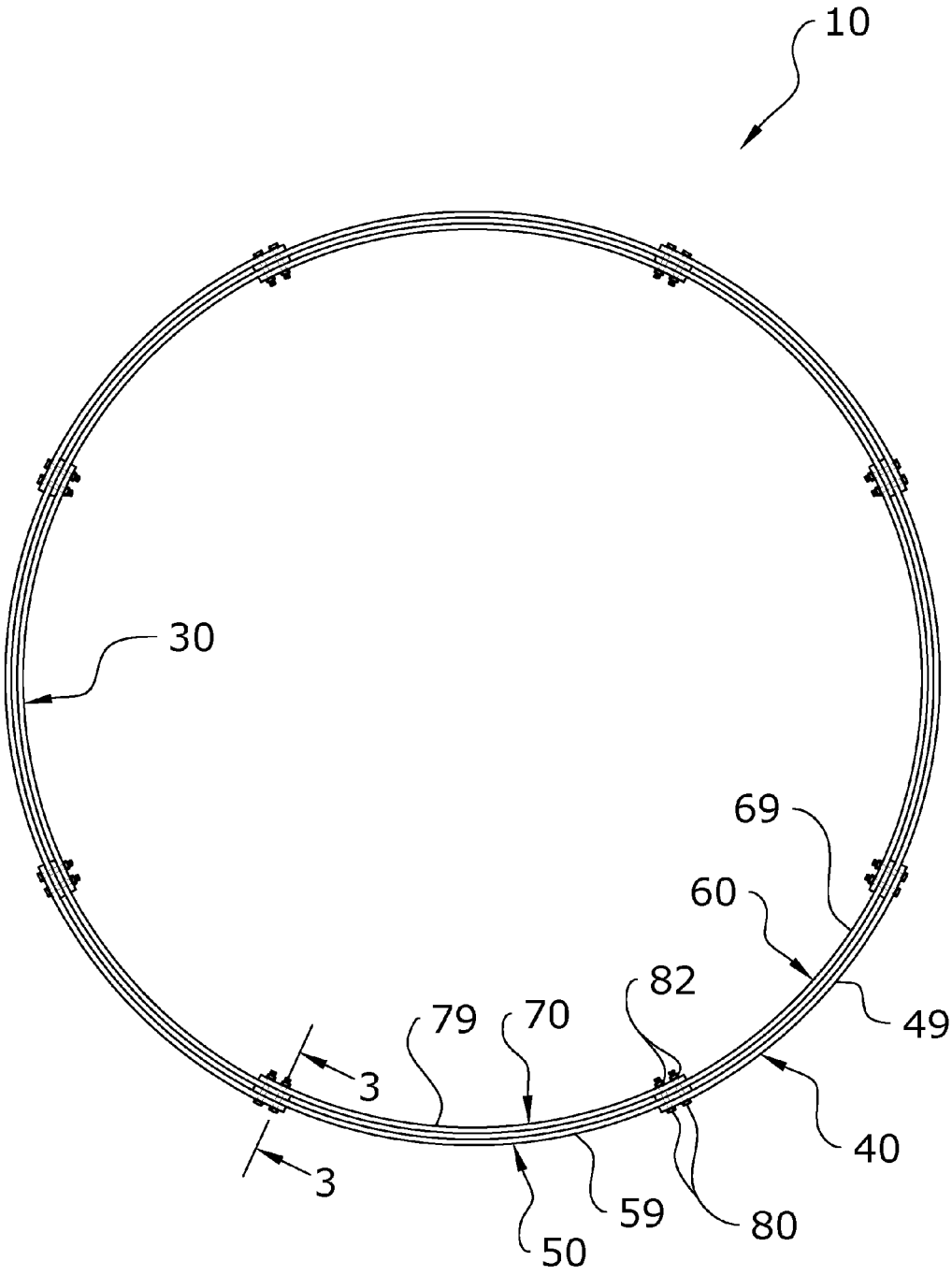
FIG. 2*d* is a top view of a complete ring of the panels attached to one another in a staggered format with one section positioned in an outside position and with the next section in an inside position.
Figure 2E:
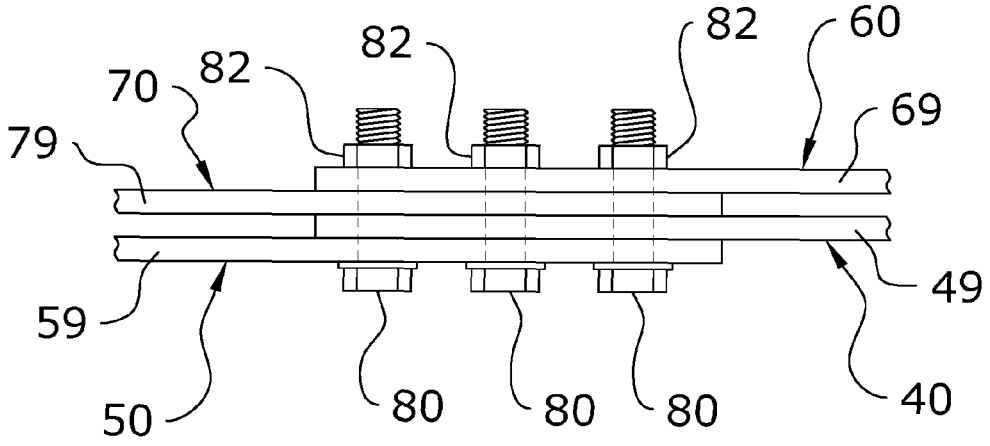
FIG. 2*e* is a top view of the vertical seam with three vertical rows of end fasteners.
Figure 2F:
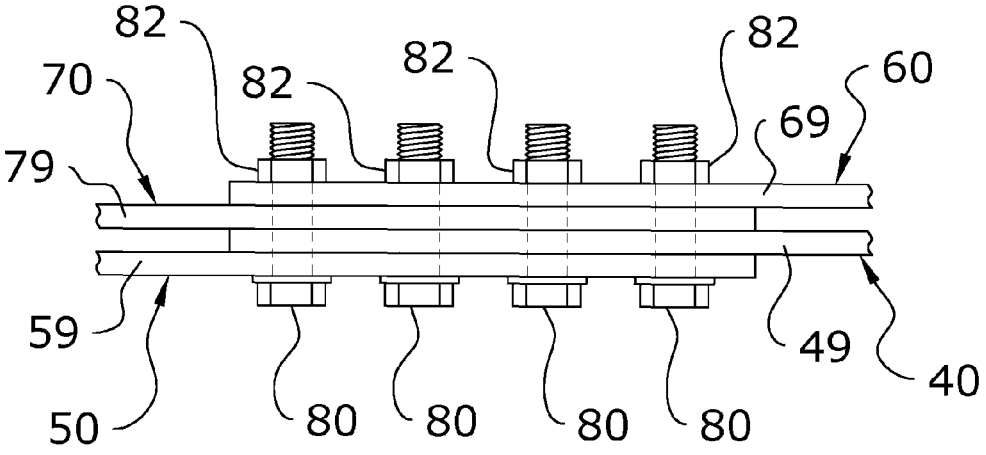
FIG. 2*f* is a top view of the vertical seam with four vertical rows of end fasteners.
Figure 3:
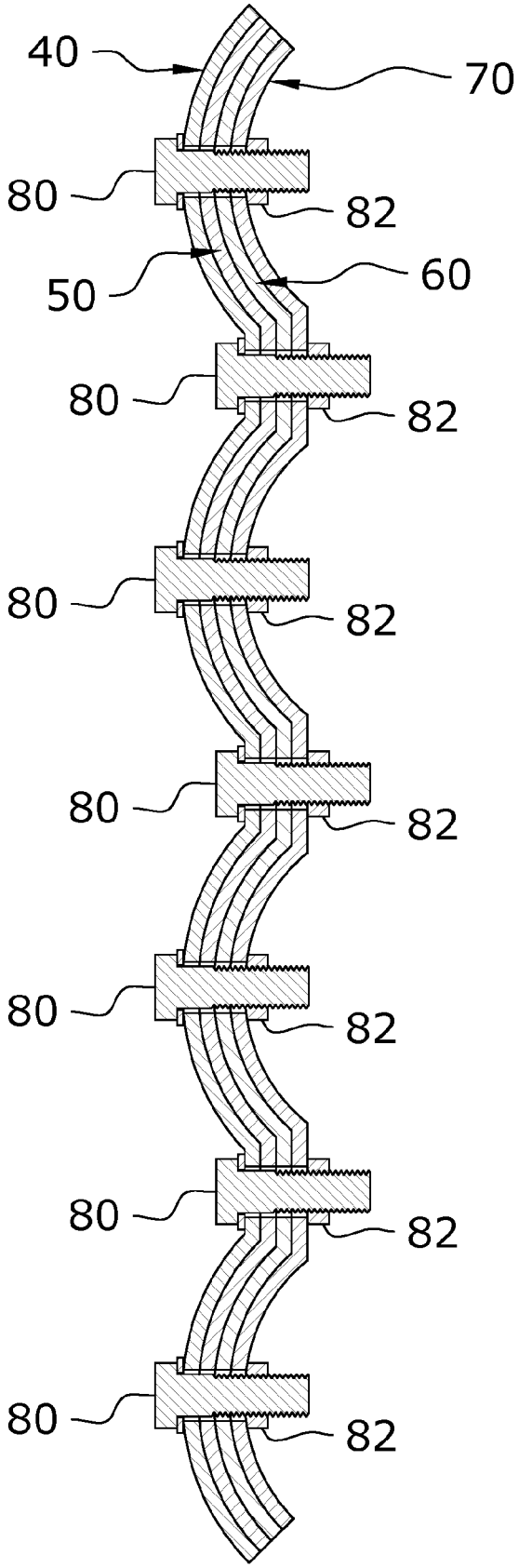
FIG. 3 is a cross sectional view taken along line 3-3 of FIG. 2*d*.

FIGS. 2*a* Through 3

In the first embodiment of the present invention illustrated in FIGS. 2*a* through 3 of the drawings, the at least three panels are comprised of four panels and end portions for each of the four panels 40, 50, 60, 70 are preferably connected to the vertical seam 32. Connecting four panels 40, 50, 60, 70 together creates three shear points for each of the end fasteners 80 connecting the end portions of the panels 40, 50, 60, 70 thereby allowing either a reduced number of end fasteners 80 to be used for the vertical seam 32 or a smaller size bolt to be used for the vertical seam 32. In addition, the force of the particulate material (e.g. grain) within the wall 30 of the storage bin is distributed to two wall 30 panels in each opposing horizontal direction of the vertical seam 32 thereby reducing the chance of the panels 40, 50, 60, 70 tearing.

As best illustrated in FIG. 2*a* of the drawings, the panels 40, 50, 60, 70 are comprised of a first panel 40, a second panel 50, a third panel 60 and a fourth panel 70. Each of the panels 40, 50, 60, 70 has a curved shape commonly utilized within the grain bin industry. The panels 40, 50, 60, 70 are further preferably comprised of an elongated rectangular structure such as a 10 feet long by 4 feet high.

As shown in FIG. 2*a*, the first panel 40 has a first lower edge 41, a first upper edge 49, at least one vertical row of first end apertures 46 within each end portion of the first panel 40, a row of first upper apertures 42 and a row of first lower apertures 44. The first upper apertures 42 and the first lower apertures 44 are used for securing to adjacent rows of ring structures when stacking a plurality of ring structures to form the wall 30 of the grain bin. A plurality of fasteners extend through the first upper apertures 42 and the first lower apertures 44 each forming a horizontal seam 34 with the adjacent row of sections that form a similar ring structure.

As further shown in FIG. 2*a*, the second panel 50 has a second lower edge 51, a second upper edge 59, at least one vertical row of second end apertures 56 within each end portion of the second panel 50, a row of second upper apertures 52 and a row of second lower apertures 54. The second upper apertures 52 and the second lower apertures 54 are used for securing to adjacent rows of ring structures when stacking a plurality of ring structures to form the wall 30 of the grain bin. A plurality of fasteners extend through the second upper apertures 52 and the second lower apertures 54 each forming a horizontal seam 34 with the adjacent row of sections that form a similar ring structure.

As further shown in FIG. 2*a*, the third panel 60 has a third lower edge 61, a third upper edge 69, at least one vertical row of third end apertures 66 within each end portion of the third panel 60, a row of third upper apertures 62 and a row of third lower apertures 64. The third upper apertures 62 and the third lower apertures 64 are used for securing to adjacent rows of ring structures when stacking a plurality of ring structures to form the wall 30 of the grain bin. A plurality of fasteners extend through the third upper apertures 62 and the third lower apertures 64 each forming a horizontal seam 34 with the adjacent row of sections that form a similar ring structure.

As further shown in FIG. 2*a*, the fourth panel 70 has a fourth lower edge 71, a fourth upper edge 79, at least one vertical row of fourth end apertures 76 within each end portion of the fourth panel 70, a row of fourth upper apertures 72 and a row of fourth lower apertures 74. The fourth upper apertures 72 and the fourth lower apertures 74 are used for securing to adjacent rows of ring structures when stacking a plurality of ring structures to form the wall 30 of the grain bin. A plurality of fasteners extend through the fourth upper apertures 72 and the fourth lower apertures 74 each forming a horizontal seam 34 with the adjacent row of sections that form a similar ring structure.

The at least one vertical row of first end apertures 46 is aligned with the at least one vertical row of second end apertures 56, the at least one vertical row of third end apertures 66 and the at least one vertical row of fourth end apertures 76 as illustrated in FIG. 2*a* of the drawings. A plurality of end fasteners 80 extend through the at least one vertical row of first end apertures 46, the at least one vertical row of second end apertures 56, the at least one vertical row of third end apertures 66 and the at least one vertical row of fourth end apertures 76. A plurality of end nuts 82 are threadably attached to the distal ends of the plurality of end fasteners 80 as best illustrated in FIG. 2*c* of the drawings.

At the vertical seam 32 formed by the panels 40, 50, 60, 70, the first panel 40 extends a first direction away from the vertical seam 32, the second panel 50 extends a second direction away from the vertical seam 32, the third panel 60 extends the direction away from the vertical seam 32 and the fourth panel 70 extends the second direction away from the vertical seam 32. The first direction is opposite of the second direction and the first direction (and the second direction) is horizontally aligned as illustrated in FIGS. 2*b* and 2*c* of the drawings.

As illustrated in FIG. 2*c*, the first panel 40 is preferably positioned between the second panel 50 and the fourth panel 70. As further illustrated in FIG. 2*c*, the second panel 50 is preferably positioned adjacent to the fourth panel 70. In addition, the second panel 50 is preferably positioned adjacent to an inner side of the fourth panel 70 (wherein the inner side faces the interior of the grain bin). The first panel 40 is preferably positioned adjacent to an outer side of the fourth panel 70 opposite of the inner side of the fourth panel 70. The distal ends of the first panel 40 and the second panel 50 are preferably aligned with one another as further shown in FIG. 2*c* of the drawings. As best illustrated in FIG. 3 of the drawings, the panels 40, 50, 60, 70 are preferably touching each adjacent panel at the vertical seam 32 with the end fasteners 80 retaining the panels 40, 50, 60, 70 together.

As illustrated in FIGS. 2*a* through 2*f* of the drawings, the plurality of fasteners are preferably comprised of at least two vertical rows of fasteners securing the first panel 40, the second panel 50, the third panel 60 and the fourth panel 70 together at their respective end portions. FIGS. 2*a* through 2*d* illustrate the usage of two vertical row of end fasteners 80, FIG. 2*e* illustrates the usage of three vertical rows of end fasteners 80 and FIG. 2*f* illustrates the usage of four vertical rows of end fasteners 80. A single vertical row of end fasteners 80 may be utilized in situations where the load forces are not as significant.

C. Second Embodiment

Figure 4C:
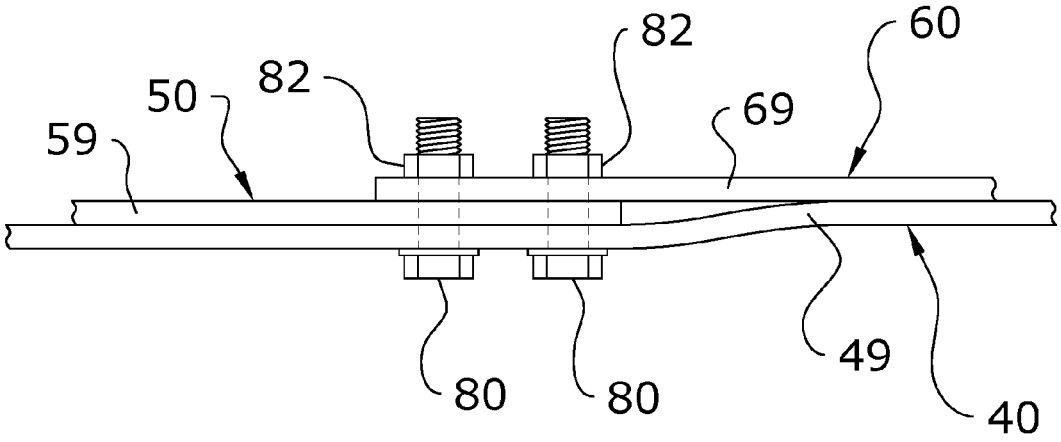
FIG. 4*c* is a top view of the vertical seam for the alternative embodiment.
Figure 4D:
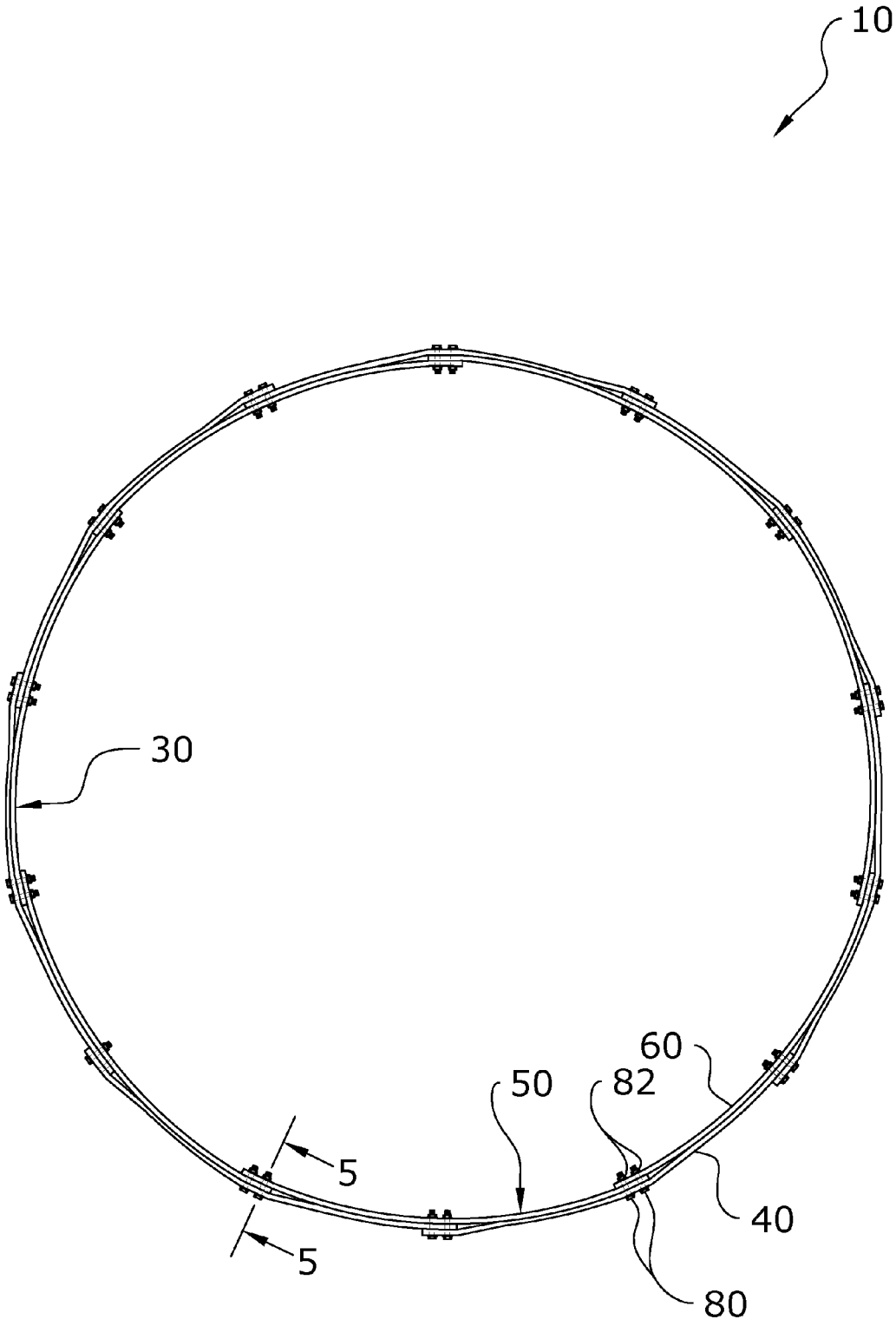
FIG. 4*d* is a top view of the alternative embodiment assembled into a complete ring of panels.
Figure 4E:
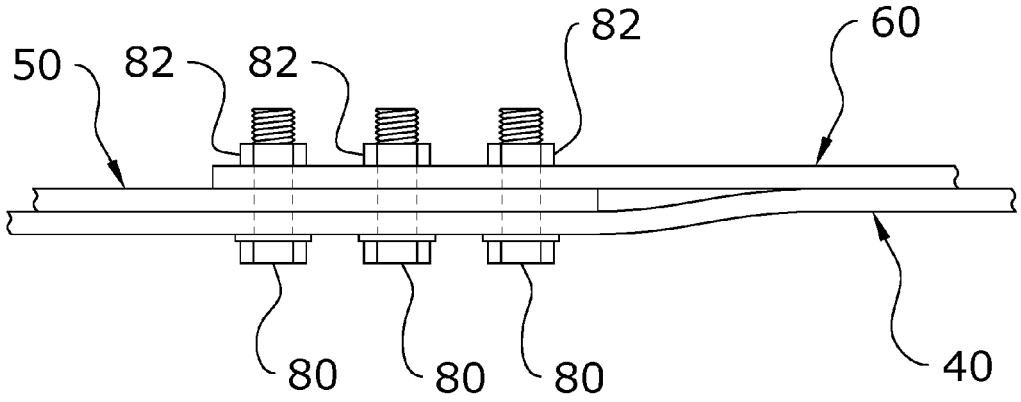
FIG. 4*e* is a top view of a vertical seam for the alternative embodiment having three vertical rows of fasteners.
Figure 4F:
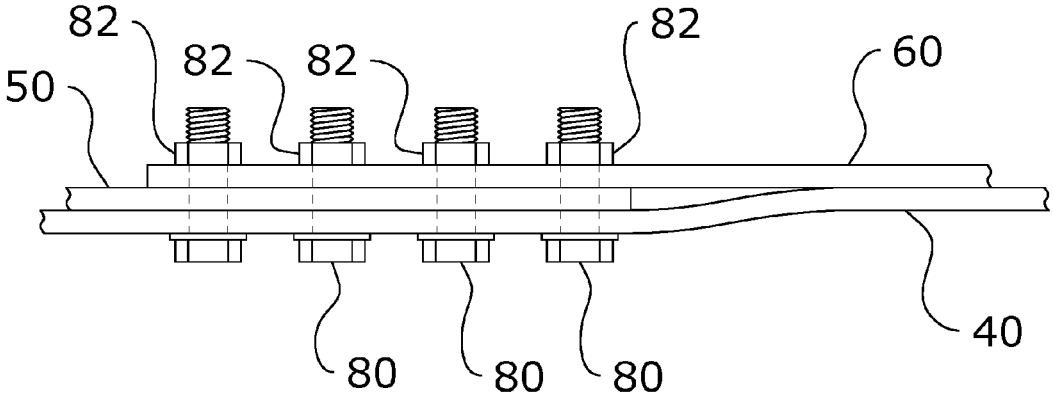
FIG. 4*f* is a top view of a vertical seam for the alternative embodiment having four vertical rows of fasteners.
Figure 4G:
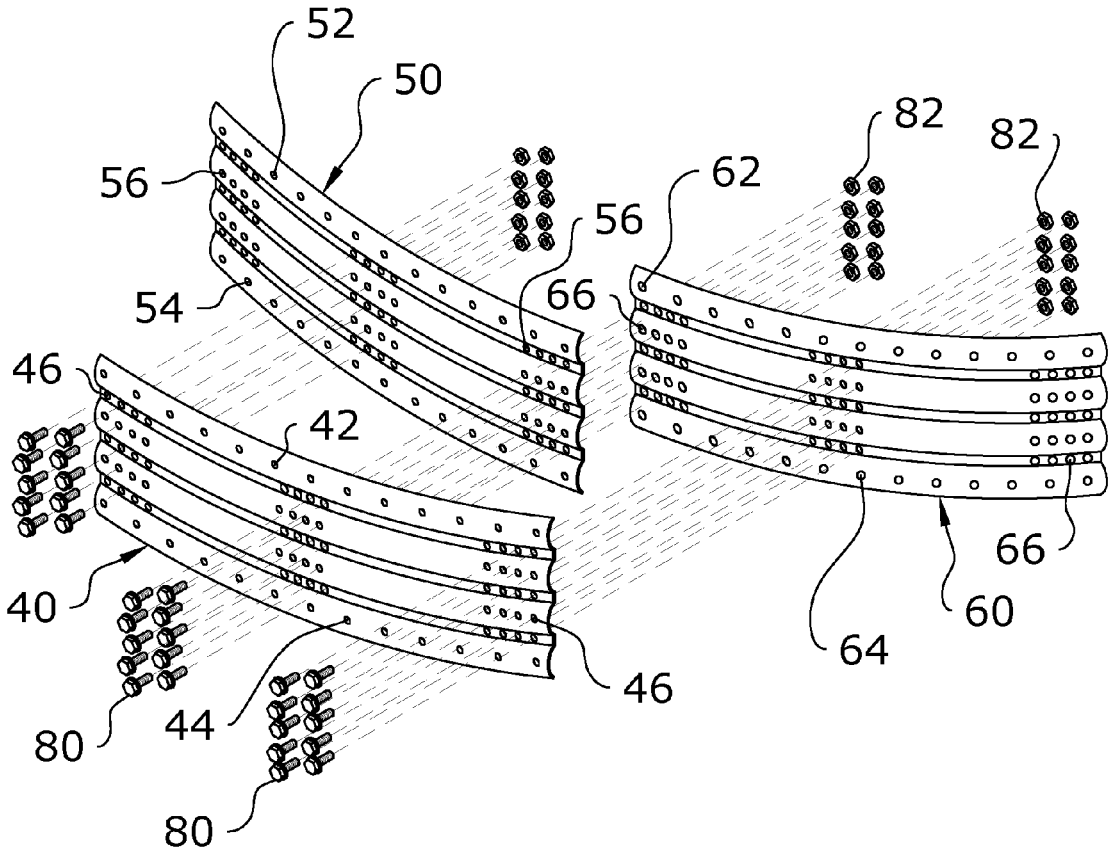
FIG. 4*g* is an exploded upper perspective view of the alternative embodiment having four vertical rows of fasteners for each vertical seam.
Figure 5:
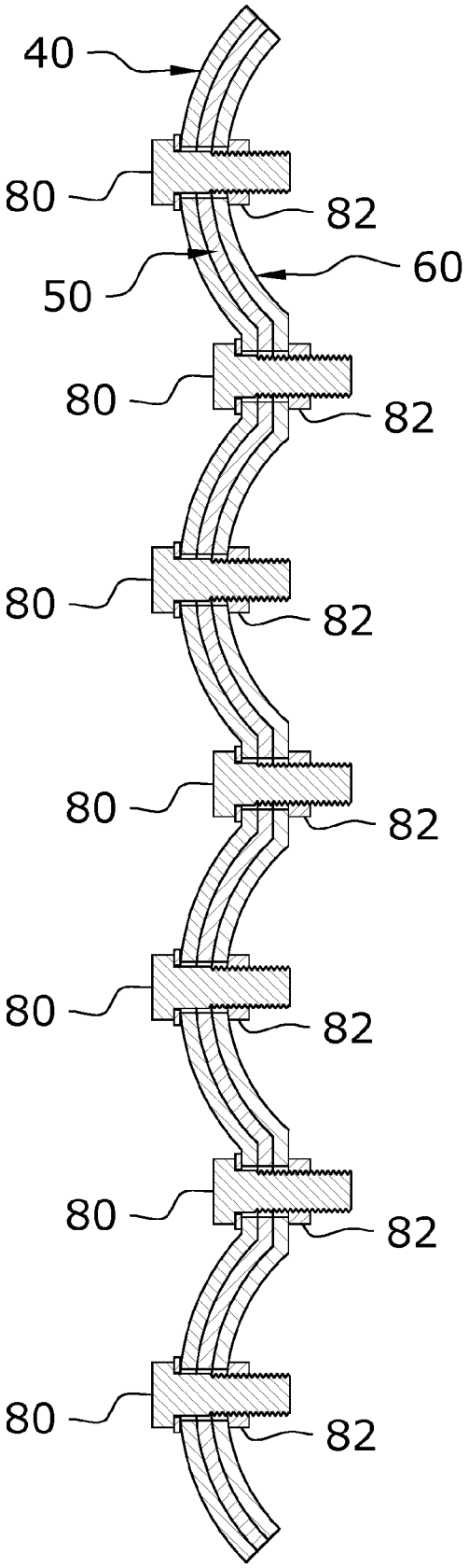
FIG. 5 is a cross sectional view taken along line 5-5 of FIG. 4*d*.

FIGS. 4*a* Through 5

FIGS. 4*a* through 5 illustrate a second embodiment of the present invention comprised of a first panel 40, a second panel 50 and a third panel 60 for each section thereby eliminating the fourth panel 70 at the vertical seam 32. With the second embodiment, the first panel 40 passes through the vertical seam 32 thereby extending in both horizontal directions from the vertical seam 32.

The panels 40, 50, 60 are the same as discussed for the first embodiment panels 40, 50, 60 with the exception that each of the panels 40, 50, 60 includes a set of intermediate apertures 48, 58, 68 that are aligned with the corresponding end apertures 56, 66 for the panels 40, 50, 60. The intermediate apertures 48, 58, 68 are not positioned near the ends of the panels 40, 50, 60 and instead are centrally positioned within the respective panels 40, 50, 60 as illustrated in FIG. 4*a*. The intermediate apertures 48, 58, 68 allow for at least one panel to pass through each vertical seam 32 wherein that panel extends to connect the opposing vertical seams 32 on both sides of the selected vertical seam 32 as best illustrated in FIG. 4*a* of the drawings.

The at least one vertical row of first intermediate apertures 48 is aligned with the at least one vertical row of second end apertures 56 within the second panel 50 and the at least one vertical row of third end apertures 66 within the third panel 60. A plurality of end fasteners 80 extend through the at least one vertical row of first intermediate apertures 48, the at least one vertical row of second end apertures 56 and the at least one vertical row of third end apertures 66. As with the first embodiment, there may be one, two, three, four or more vertical rows of apertures (and corresponding end fasteners 80) for each vertical seam 32.

At the vertical seam 32, the second panel 50 extends a first direction away from the vertical seam 32, the third panel 60 extends a second direction away from the vertical seam 32 as shown in FIG. 4*c* of the drawings. The first direction is opposite of the second direction and the first direction (and the second direction) is horizontally aligned.

The second panel 50 is preferably positioned between the first panel 40 and the third panel 60 as shown in FIG. 4*c* of the drawings. The first panel 40 continues through the vertical seam 32 so that at least one panel extends between the two opposing vertical seams 32 surrounding the selected vertical seam 32. This provides two shear points and increased strength since at least one panel extends completely through each of the vertical seams 32 in each ring structure.

The upper apertures and the lower apertures of the inner panel (e.g. the fourth upper/lower apertures 72/74 in the fourth panel 70 in FIG. 2*a* and the third upper/lower apertures 62/64 of the third panel 60 on FIG. 4*a*) are each distally spaced apart a distance that is less than the upper apertures and the lower apertures of the outer panel (e.g. the first upper/lower apertures 42/44 in the fourth panel 70 in FIG. 2*a* and the third panel 60 on FIG. 4*a*) to compensate for the smaller circumference and smaller radius of curvature for the inner panel compared to the outer panel which has a larger circumference and a larger radius of curvature. For example using a 10 foot length of panel, the upper/lower apertures of the inner panel would be approximately 9.365 inches apart from one another and the upper/lower apertures of the outer panel would be approximately 9.375 inches apart from one another. Hence, the spacing of the of the upper/lower apertures of the inner panel is approximately 0.010 inches less than the spacing of the upper/lower apertures of the outer panel. This allows for the fasteners 80 to be inserted with the apertures all aligned thereby reducing the forces applied to the fasteners 80.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A wall for a particulate material storage bin having a plurality of sections connected together forming a ring structure, at least one of the plurality of sections comprising:

at least three panels positioned in a row of the wall and connected together via a first vertical seam with a plurality of fasteners, wherein the at least three panels are comprised of:

a first panel having a lower edge, an upper edge, a first end portion, a second end portion opposite of the first end portion, a first horizontal row of apertures extending along an upper portion of the first panel, a vertical row of first intermediate apertures, and a vertical row of first apertures within the first end portion of the first panel, wherein the first panel passes through the first vertical seam thereby extending in both horizontal directions from the first vertical seam, wherein the first end portion of the first panel terminates at a second vertical seam and wherein the second end portion of the first panel terminates at a third vertical seam, wherein the first vertical seam is substantially parallel with respect to the second vertical seam and the third vertical seam;

a second panel having a lower edge, an upper edge, a first end portion, a second end portion opposite of the first end portion of the second panel, a second horizontal row of apertures extending along an upper portion of the second panel, a vertical row of second intermediate apertures, and a vertical row of second apertures within the second end portion of the second panel; and a third panel having a lower edge, an upper edge, a first end portion, a second end portion opposite of the first end portion of the third panel, a third horizontal row of apertures extending along an upper portion of the third panel, a vertical row of third intermediate apertures, and a vertical row of third apertures within the first end portion of the third panel, wherein the vertical row of first intermediate apertures is aligned with the vertical row of second apertures and the vertical row of third apertures.

2. The wall for a particulate material storage bin of claim 1, wherein the first panel is positioned outside of the second panel and the third panel.

3. The wall for a particulate material storage bin of claim 1, wherein the second panel is positioned between the first panel and the third panel.

4. The wall for a particulate material storage bin of claim 1, wherein the vertical row of first intermediate apertures are centrally positioned near a center axis of the first panel.

5. The wall for a particulate material storage bin of claim 1, wherein a plurality of apertures within the vertical row of first intermediate apertures are vertically aligned.

6. The wall for a particulate material storage bin of claim 1, wherein the lower edge of the first panel is aligned with the lower edge of the second panel and the lower edge of the third panel.

7. The wall for a particulate material storage bin of claim 1, wherein the first end portion of the third panel is aligned with the second end portion of the second panel along the first vertical seam.

8. The wall for a particulate material storage bin of claim 1, wherein at least two of the at least three panels have their respective end portions connected to the first vertical seam.

9. The wall for a particulate material storage bin of claim 1, wherein at the first vertical seam, the second panel extends a first direction away from the first vertical seam and the third panel extends a second direction away from the first vertical seam, wherein the first direction is opposite of the second direction and wherein the first direction is horizontally aligned.

10. The wall for a particulate material storage bin of claim 1, wherein the first horizontal row of apertures are each spaced apart by a first distance, wherein the second horizontal row of apertures are each spaced apart by a second distance, wherein the third horizontal row of apertures are each spaced apart by a third distance, and wherein the third distance is less than the first distance.

11. The wall for a particulate material storage bin of claim 10, wherein the third distance is approximately 0.010 inches less than the first distance.

12. The wall for a particulate material storage bin of claim 10, wherein the first panel is positioned outside of the second panel, wherein the second panel is positioned between the first panel and the third panel, and wherein the third panel is positioned inside of the second panel.

13. The wall for a particulate material storage bin of claim 1, wherein the vertical row of first apertures, the vertical row of second apertures and the vertical row of third apertures are each vertically aligned and parallel with respect to one another.

14. The wall for a particulate material storage bin of claim 1, wherein the vertical row of first intermediate apertures, the vertical row of second intermediate apertures and the vertical row of third intermediate apertures are parallel with respect to one another.

15. The wall for a particulate material storage bin of claim 14, wherein the vertical row of second intermediate apertures is aligned with the vertical row of first apertures.

16. The wall for a particulate material storage bin of claim 15, wherein the vertical row of third intermediate apertures is aligned with a vertical row of apertures within the second end portion of the first panel.

17. A wall for a particulate material storage bin having a plurality of sections connected together forming a ring structure, at least one of the plurality of sections comprising:

at least three panels positioned in a row of the wall and connected together via a first vertical seam with a plurality of fasteners, wherein the at least three panels are comprised of:

a first panel having a lower edge, an upper edge, a first end portion, a second end portion opposite of the first end portion, a first horizontal row of apertures extending along an upper portion of the first panel, a vertical row of first intermediate apertures, and a vertical row of first apertures within the first end portion of the first panel, wherein the first panel passes through the first vertical seam thereby extending in both horizontal directions from the first vertical seam, wherein the first end portion of the first panel terminates at a second vertical seam and wherein the second end portion of the first panel terminates at a third vertical seam, wherein the first vertical seam is substantially parallel with respect to the second vertical seam and the third vertical seam, wherein the vertical row of first intermediate apertures are centrally positioned near a center axis of the first panel, wherein a plurality of apertures within the vertical row of first intermediate apertures are vertically aligned;

a second panel having a lower edge, an upper edge, a first end portion, a second end portion opposite of the first end portion of the second panel, a second horizontal row of apertures extending along an upper portion of the second panel, a vertical row of second intermediate apertures, and a vertical row of second apertures within the second end portion of the second panel; and a third panel having a lower edge, an upper edge, a first end portion, a second end portion opposite of the first end portion of the third panel, a third horizontal row of apertures extending along an upper portion of the third panel, a vertical row of third intermediate apertures, and a vertical row of third apertures within the first end portion of the third panel, wherein the vertical row of first intermediate apertures is aligned with the vertical row of second apertures and the vertical row of third apertures, wherein the first end portion of the third panel is aligned with the second end portion of the second panel along the first vertical seam, wherein at the first vertical seam, the second panel extends a first direction away from the first vertical seam and the third panel extends a second direction away from the first vertical seam, wherein the first direction is opposite of the second direction and wherein the first direction is horizontally aligned.

18. The wall for a particulate material storage bin of claim 17, wherein the first panel is positioned outside of the second panel and the third panel.

19. The wall for a particulate material storage bin of claim 17, wherein the lower edge of the first panel is aligned with the lower edge of the second panel and the lower edge of the third panel.

20. A wall for a particulate material storage bin, comprising at least three panels positioned in a row of the wall and connected together via a first vertical seam with a plurality of fasteners, wherein the at least three panels are comprised of:

a first panel having a lower edge, an upper edge, a first end portion, a second end portion opposite of the first end portion, a first horizontal row of apertures extending along an upper portion of the first panel, a vertical row of first intermediate apertures, and a vertical row of first apertures within the first end portion of the first panel;

wherein the first panel passes through the first vertical seam thereby extending in both horizontal directions from the first vertical seam, wherein the first end portion of the first panel terminates at a second vertical seam and wherein the second end portion of the first panel terminates at a third vertical seam, wherein the first vertical seam is substantially parallel with respect to the second vertical seam and the third vertical seam, wherein the vertical row of first intermediate apertures are centrally positioned near a center axis of the first panel, wherein a plurality of apertures within the vertical row of first intermediate apertures are vertically aligned;

a second panel having a lower edge, an upper edge, a first end portion, a second end portion opposite of the first end portion of the second panel, a second horizontal row of apertures extending along an upper portion of the second panel, a vertical row of second intermediate apertures, and a vertical row of second apertures within the second end portion of the second panel;

wherein the vertical row of second intermediate apertures is aligned with the vertical row of first apertures; and a third panel having a lower edge, an upper edge, a first end portion, a second end portion opposite of the first end portion of the third panel, a third horizontal row of apertures extending along an upper portion of the third panel, a vertical row of third intermediate apertures, and a vertical row of third apertures within the first end portion of the third panel;

wherein the vertical row of first intermediate apertures is aligned with the vertical row of second apertures and the vertical row of third apertures, wherein the first end portion of the third panel is aligned with the second end portion of the second panel along the first vertical seam, wherein at the first vertical seam, the second panel extends a first direction away from the first vertical seam and the third panel extends a second direction away from the first vertical seam, wherein the first direction is opposite of the second direction and wherein the first direction is horizontally aligned, wherein the lower edge of the first panel is aligned with the lower edge of the second panel and the lower edge of the third panel, wherein the vertical row of first apertures, the vertical row of second apertures and the vertical row of third apertures are each vertically aligned and substantially parallel with respect to one another, wherein the vertical row of first intermediate apertures, the vertical row of second intermediate apertures and the vertical row of third intermediate apertures are substantially parallel with respect to one another.

* * * * *